US005296308A

United States Patent [19]

Caccavale et al.

[11] Patent Number: 5,296,308

[45] Date of Patent: Mar. 22, 1994

[54] INVESTMENT CASTING USING CORE WITH INTEGRAL WALL THICKNESS CONTROL MEANS

[75] Inventors: Charles F. Caccavale, Wharton, N.J.; William E. Sikkenga, Twin Lake, Mich.

[73] Assignee: Howmet Corporation, Greenwich, Conn.

[21] Appl. No.: 931,221

[22] Filed: Aug. 10, 1992

[51] Int. Cl.[5] ..... B22C 9/04

[52] U.S. Cl. ..... 428/586; 164/361; 164/516

[58] Field of Search ..... 164/122.1, 122.2, 516, 164/361, 369, 370, 340; 428/586

[56] References Cited

U.S. PATENT DOCUMENTS

| | | | |
|---|---|---|---|
| 2,084,247 | 6/1937 | Dockray et al. . | |
| 3,596,703 | 8/1971 | Bishop et al. . | |
| 3,659,645 | 5/1972 | Rose . | |
| 3,965,963 | 6/1976 | Phipps et al. | 164/122.1 |
| 4,068,702 | 1/1978 | Herold | 164/30 |
| 4,078,598 | 3/1978 | Kelso et al. | 164/122.1 |
| 4,283,835 | 8/1981 | Obrochta et al. | 164/45 |
| 4,487,246 | 12/1984 | Frasier . | |
| 4,811,778 | 3/1989 | Allen et al. . | |

FOREIGN PATENT DOCUMENTS

| | | | |
|---|---|---|---|
| 56-117861 | 9/1981 | Japan | 164/340 |

*Primary Examiner*—Kuang Y. Lin

*Attorney, Agent, or Firm*—Flynn, Thiel, Boutell & Tanis

[57] ABSTRACT

A method of making a casting having an internal passage involves the steps of forming a core having an external surface configured to form the passage in the casting and having a plurality of integrally formed protrusions extending from the external surface at stressed regions thereof (e.g., thermally stressed regions) prone to be distorted from a master core configuration, and positioning the core in a pattern molding cavity by engagement of the protrusions with rigid walls defining the molding cavity such that the core is conformed substantially to a predetermined and/or empirically determined relationship between the master core configuration and the molding cavity as if the core corresponded to the master core configuration. A fugitive pattern corresponding to the casting to be formed is then molded about the external surface of the core while the core is supported in the aforementioned relationship relative to the molding cavity, whereby the wall thickness of the pattern is controlled about the core. A ceramic shell mold is then invested about the pattern and core such that the protrusions can engage the mold in the event of core movement during subsequent steps.

15 Claims, 4 Drawing Sheets

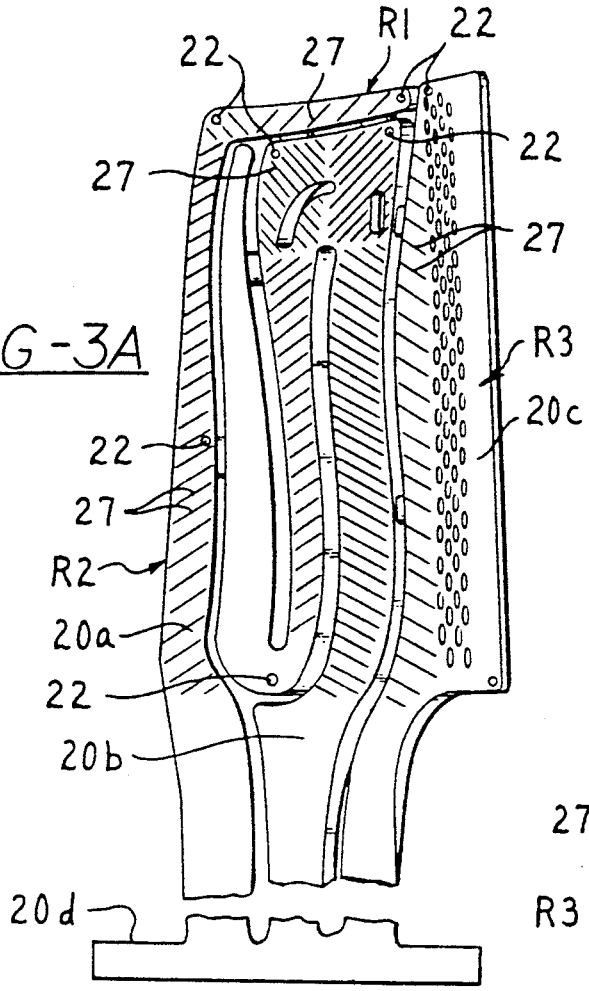
FIG-3A
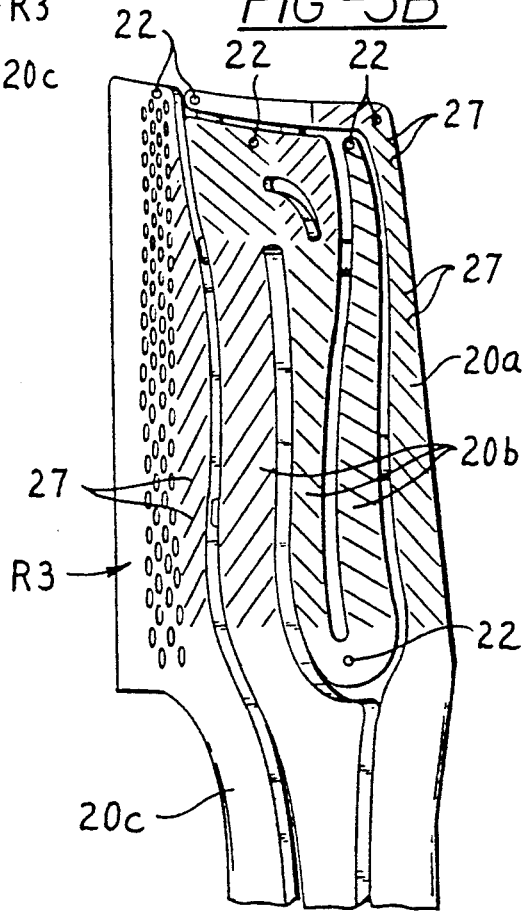
FIG-3B
FIG - 4
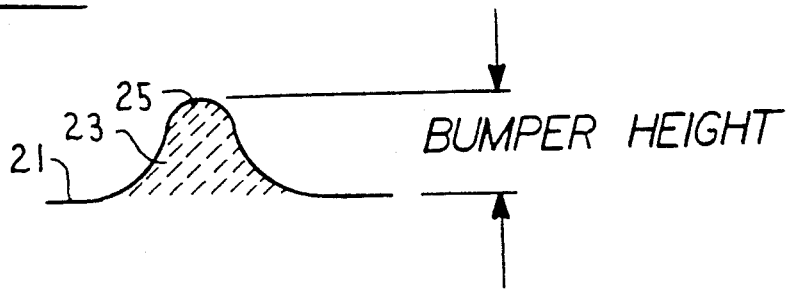

INVESTMENT CASTING USING CORE WITH INTEGRAL WALL THICKNESS CONTROL MEANS

FIELD OF THE INVENTION

The present invention relates to the precision investment casting of hollow parts using a core including means for providing improved wall thickness control between an internal passage and outer surface of the cast part.

BACKGROUND OF THE INVENTION

Modern investment casting procedures are frequently used to produce castings which have complex hollow interiors. Illustrative examples of such cast articles are cast turbine blades and vanes of a gas turbine engine wherein the blades/vanes include a complex hollow interior for conducting cooling air through the blade/-vane interior during use in the hot turbine environment. The hollow interior of the blade/vane may comprise one or more passageways that are formed in the airfoil and root to conduct air through for cooling purposes during use in the turbine.

Such complex interiors are formed in the blade/vane by positioning a suitably configured ceramic core in the investment casting mold and solidifying the molten metal in the mold about the core. The core is removed from the solidified casting by leaching or other means, leaving a casting having a hollow interior corresponding to the configuration of the core.

Typically, the core is provided with "prints" at one or both ends located beyond the pattern portion defining the internal wall of the part or article to be cast so that these prints will be embedded in the ceramic material invested about the pattern/core during the mold formation operation. The core "prints" are not disposed in the mold cavity where the casting is solidified.

As the performance requirements for turbine blades/-vanes have increased, the cooling requirements and thus the complexity of the internal passageways formed in the part have become more complex. This has necessitated use of even more complex cores.

A problem has been experienced in casting some turbine blades/vanes when there is movement or shift of the core in the mold during removal of the pattern material, during preheating of the mold prior to pouring the molten metal therein, and during casting of the molten metal into the mold. For example, during casting, the core can exhibit a temperature profile along its length that causes unwanted core movement. In particular, even a slight core displacement during pattern removal, during mold preheating, and/or during metal pouring has been found to result in unacceptable variations in the wall thickness of the hollow cast blade/-vane, especially when relatively thin ceramic cores are used and especially when single crystal or directionally solidified castings are formed in a mold heated to an elevated temperature prior to metal pouring and kept in this condition for a long period of time during solidification of the molten metal.

The use of relatively thin, complex cores presents additional problems as a result of warpage oftentimes associated with such thin cores. In particular, certain regions of these cores become warped during a firing operation employed in their manufacture and during the subsequent processing as described above (e.g., during pattern removal, mold preheating and metal pouring).

Such warpage can ultimately produce unacceptable wall thickness variations in the hollow casting made therewith.

Various attempts have been made to provide means for accurately supporting cores in an investment casting mold. For example, chaplets such as described in U.S. Pat. No. 2,084,247 represent well-known prior core supporting techniques. Other techniques specifically developed for use in connection with ceramic molds/-cores are set forth in U.S. Pat. Nos. 3,596,703; 3,659,645; 4,487,246; and 4,811,778. Some of these techniques use platinum chaplets, pins and similar devices extending through the wax pattern into contact with the core at one end and into the mold wall at the other end to position the core in the mold. However, these techniques create a problem of unwanted metal on the casting surfaces where the chaplets/pins extend into the mold wall. In effect, the molten metal cast into the mold eventually fills the space occupied by the chaplet/pin in the mold wall. This problem leads to the requirement of additional mechanical finishing operations to remove the unwanted metal, dimensional control variations, and possible unwanted nucleation/ recrystallization.

The aforementioned U.S. Pat. No. 3,596,703 describes a prior core positioning technique wherein holes are drilled in the wax pattern formed about the core until the holes reach the core. The ceramic mold is then invested about the wax pattern/core assembly so that ceramic material fills the drilled holes to provide ceramic plugs for supporting the core in the mold when the wax pattern is subsequently removed. When molten metal is cast and solidified in the mold, holes are left on the casting where the ceramic support plugs existed and are then plugged or removed. This technique involves laborious and costly hole drilling operations in the wax pattern and hole filling/removal operations on the casting.

SUMMARY OF THE INVENTION

The present invention contemplates a method of making a casting with improved wall thickness control between an internal passage and outer casting surface wherein the method involves the steps of forming a core having an external surface configured to form the internal passage in the casting and having a plurality of integrally formed protrusions (e.g., bumpers) extending from the external core surface at critically stressed regions thereof (e.g., thermally and/or mechanically stressed regions) prone to be distorted from a predetermined and/or empirically determined relationship of a master core configuration relative to a molding cavity for various reasons including core waxing/dewaxing, mold firing, mold preheat, and casting pouring. The core protrusions are present at stressed regions as required for mold wall thickness control. The core protrusions are present on the core external surface that forms an internal passage surface on the final casting and not a region of the casting that is subsequently trimmed off or otherwise removed.

The aforementioned predetermined relationship is based typically on engineering print tolerances, whereas the empirically determined relationship is based on casting trials that indicate the core-to-molding cavity relationship needed.

The core is positioned in a pattern molding cavity by engagement of the protrusions with rigid walls defining the molding cavity such that the core is substantially conformed by such engagement to the predetermined and/or empirically determined relationship between the master core configuration and the molding cavity in spite of any initial distortion of the core from the master core configuration. A fugitive pattern corresponding to the casting to be formed is then molded about the external core surface while the core is supported and conformed in the aforementioned relationship, whereby the wall thickness of the pattern is controlled about the core. The outer ends of the protrusions preferably are exposed through, or recessed slightly below, the molded pattern where the outer ends engage the molding cavity walls.

A ceramic shell mold is invested about the pattern and core such that the protrusions can engage the mold when core movement (i.e., core distortion and/or displacement) occurs. The molded pattern material is then removed from the invested shell mold, leaving the core positioned in the shell mold cavity by the protrusions in accordance with the aforementioned relationship previously established between the master core configuration and the pattern molding cavity, whereby the wall thickness of the cast metal will be controlled. Molten metal is then poured or otherwise introduced into the shell mold cavity and solidified therein about the core. The shell mold and core typically are fired to develop required shell strength for casting and preheated to an elevated temperature in preparation for casting and solidification of the molten metal therein. After the metal is solidified, the shell mold and core are removed by conventional techniques to free the casting. The casting may have holes in the wall thereof in communication with the internal passage where the protrusions formerly resided. The size of the hole may vary from zero diameter (for a perfect, initially, undistorted core) to 0.012 inch diameter or larger, depending on protrusion configuration, warpage and movement of the core.

Use of the protrusions integrally formed on the core to position it in the pattern molding cavity and to ultimately position the core in the shell mold cavity substantially improves wall thickness control of the casting formed. In effect, the core protrusions reduce wall thickness tolerance by 1) initially positioning the core in the proper position relative to the pattern molding cavity and thus relative to the pattern formed and 2) minimizing core movement relative to the mold (formed about the pattern) during pattern removal, mold preheat, and melt casting.

Moreover, use of the protrusions integrally formed on the external surface of the core eliminates raised metal on the casting wall and thereby eliminates and/or dramatically reduces the need to mechanically finish (e.g., grind, blast, or belt) or otherwise further treat the casting wall to remove the excess metal. Any holes that are left in the casting wall by the removed protrusions are tolerable from a casting performance standpoint.

The present invention is advantageous in that thin ceramic cores which almost always exhibit some distortion (e.g., warpage) at one or more regions as a result of core curing steps used in core manufacture can be used in the manufacture of castings having acceptable wall thickness control. Other processing parameters, such as mold/metal temperatures and metal flow, which also affect the dimensional failure of the core, are advantageously accommodated by the present invention. As a result of the aforementioned improvements and advantages, the present invention reduces the overall cost to produce castings and provides a higher quality casting from the standpoint of controlled wall thickness. The wall thickness of the casting can be controlled to tighter tolerances than heretofore achievable.

The method of the invention is especially useful in the manufacture of a turbine airfoil casting (e.g., blade or vane) having one or more internal cooling passages therein. In the manufacture of such an airfoil, a fired ceramic core is formed to have an external surface configured to form the desired cooling passage(s) in the airfoil casting and includes a plurality of integrally formed protrusions extending from the external core surface at thin regions thereof prone to be distorted from a master core configuration because of various processing parameters employed. The core is positioned in a pattern molding cavity having a configuration corresponding to the airfoil by engagement of the protrusions with rigid walls defining the molding cavity such that the core is conformed to a predetermined and/or empirically determined relationship between the master core configuration and the molding cavity in spite of any distortion of the core from the master core configuration. A fugitive (e.g., wax) airfoil-shaped pattern is molded about the external core surface while the core is supported in the aforementioned relationship by the protrusions, whereby the wall thickness of the pattern is controlled about the core. A ceramic shell mold is invested about the pattern and core such that the protrusions can engage the mold when core movement occurs, and then the pattern is removed from the invested shell, leaving the core positioned in an air-foil-shaped shell mold cavity by the protrusions in accordance with the previously established relationship. Molten metal is then poured into the shell mold cavity and solidified therein about the core to form the airfoil casting.

In one embodiment of the invention, the core is formed by molding a ceramic slurry to the master core configuration and firing the molded core configuration at elevated temperature to impart strength thereto. Firing of the core configuration causes one or more regions of the core configuration to exhibit distortion from the master core configuration. When the core is positioned in the pattern molding cavity, the distorted region(s) are caused to conform to the master core configuration (which corresponds to the core die cavity blocks).

In another embodiment of the invention, the ceramic shell is invested about the pattern by successively applying a ceramic slurry and ceramic stucco to the pattern to build up a multi-layer shell mold.

The present invention also contemplates an assembly for making a casting having an internal passage, and a method of making the assembly, wherein the assembly comprises a shell mold defining a metal casting (mold) cavity for receiving molten metal, and a ceramic core disposed in the casting cavity, the core having an external surface configured to form the passage in the casting and having a plurality of integrally formed protrusions extending from the external surface at regions thereof prone to be distorted from the aforementioned predetermined and/or empirically determined relationship of the master core configuration relative to the molding cavity so as to engage the shell mold in the event of core movement (core distortion or movement) and position the core in the mold during the casting operation for control of the wall thickness of the casting formed in the mold.

The present invention further contemplates a ceramic core for disposition in a mold wherein the core includes an external surface configured to form a passage in the casting and having a plurality of integrally formed protrusions extending from the external surface at regions thereof prone to be distorted so as to position the core in the mold during the casting operation in a predetermined and/or empirically determined relationship for casting wall thickness control purposes. The core is preferably configured to form an air cooling passage in an airfoil.

The present invention further contemplates use of protrusions on a warpage-free ceramic core that is subjected to mold/metal temperatures which will cause the core to move. These temperatures can also negatively impact the dimensional stability of thicker core sections. The protrusions on these sections will enhance casting wall thickness control under these conditions.

The invention may be better understood when considered in light of the following detailed description of certain specific embodiments thereof which are given hereafter in conjunction with the following claims.

DESCRIPTION OF THE DRAWINGS

FIG. 3A is a schematic, partial elevational view of one side (e.g., concave side) of the core of FIG. 2.

FIG. 3B is similar to FIG. 3A but of the other side (e.g., convex side) of the core of FIG. 2.

FIG. 4 is a partial sectional view of a core protrusion or bumper formed integrally on the core external surface configured to form the internal passage in the casting.

DETAILED DESCRIPTION OF THE INVENTION

Figure 1:
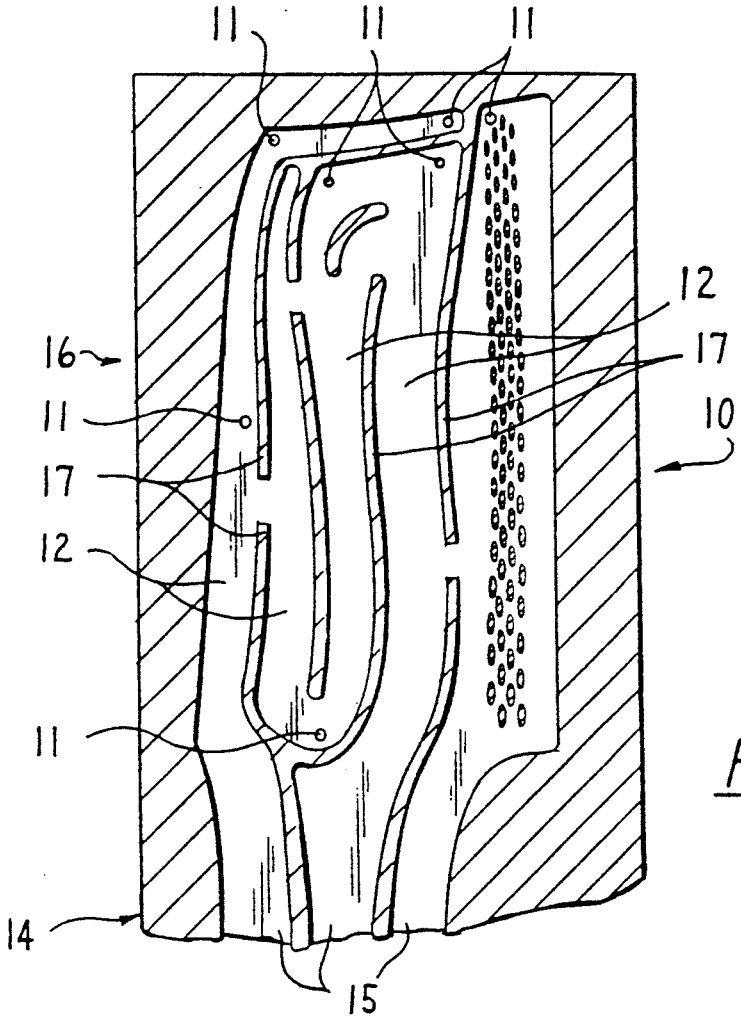
FIG. 1 is a schematic, partial side sectioned view of a hollow cast turbine blade made in accordance with one embodiment of the invention.

The method of the invention is useful in making a hollow casting having one or more internal passages wherein control of the casting wall thickness between the internal passages and outer casting surface is substantially improved. It is especially useful in the manufacture of a hollow turbine blade or vane 10 (hereafter airfoil 10) having one or more internal cooling passages 12 extending through the root 14 and airfoil 16 thereof, as illustrated for example in FIG. 1, for cooling the blade or vane in the hot service environment of the turbine section of a gas turbine engine. The cooling passages 12 receive compressor air via air inlets or openings 15 in the blade or vane root 14 (partially shown). The hollow airfoil blade or vane 10 may be cast to have an equiaxed, directionally solidified, or single crystal grain microstructure by well known casting procedures.

In the casting of the hollow airfoil 10 using these casting procedures, the present invention utilizes a single or multi-piece ceramic core 20 having concave and convex external surfaces 21*a*,21*b* (FIG. 2) configured to form the passages 12 and internal ribs 17 of FIG. 1 of the airfoil 16. The core 20 may comprise a plurality of elongated sections 20*a*,20*b*,20*c* for forming cooling passages in the airfoil 16 and interconnected at a common lower section 20*d*, FIG. 3A, for forming the cooling passages in the blade or vane root. Alternately, separate core sections 20*a*,20*b*,20*c* unconnected at the root section can be used in practicing the invention.

Elongated recesses 27 are molded in the core sections 20*a*,20*b*,20*c* for forming raised metal segments on the inner surface that increase cooling air movement (air turbulence), thereby improving the distribution of cooling air.

In accordance with the invention, the ceramic core 20 additionally includes a plurality of protrusions or bumpers 22 extending outwardly from one or both of the external core surfaces 21*a*,21*b* (i.e., core surfaces defining passages in the airfoil 16) at key stress regions where core distortion or displacement occurs (i.e., where out of tolerance deviation occurs from a predetermined relationship and/or empirically determined relationship of a master core configuration to a molding cavity such as the pattern molding cavity and mold casting cavity to be described). The predetermined relationship comprises the core-to-pattern molding cavity relationship and tolerances set forth on design prints, such as engineering drawings. The empirically determined relationship comprises a core-to-pattern molding cavity relationship determined from casting trials to be needed to produce acceptable castings from a casting wall thickness control standpoint. Such empirically determined relationship is selected as needed based on actual casting trials to make acceptable cast blades or vanes (or other articles).

In the claims set forth herebelow, the term "determined" relationship means the aforementioned predetermined relationship or the aforementioned empirically determined relationship, or both.

Core distortion or displacement can occur during the core manufacturing process wherein a green (raw) molded core is fired at elevated temperature to develop required core strength. For example, thin regions R1 and R3 of the core 20 are prone to warpage during firing of a green core 20 manifested as twisting or bowing of the core. Moreover, core distortion or displacement can also occur during a subsequent pattern removal operation, a mold preheating operation, and/or a metal casting/solidifying operation to be described, even when using initially undistorted cores. For example, other regions such as the leading edge passageway-forming region R2 and thin trailing edge-forming region R3 are prone to distortion (such as warpage) during the mold preheating operation wherein the mold is heated to an elevated casting temperature. The core protrusions 22 are provided at these key stress regions to counteract distortion or displacement thereof that leads to unacceptable wall thickness variations. In other words, the core protrusions 22 are present in number and location as needed for wall thickness control purposes. At the leading edge passage-way-forming region R2, the protrusions 22 may be staggered in positions along the length of the region R2.

Figure 2:
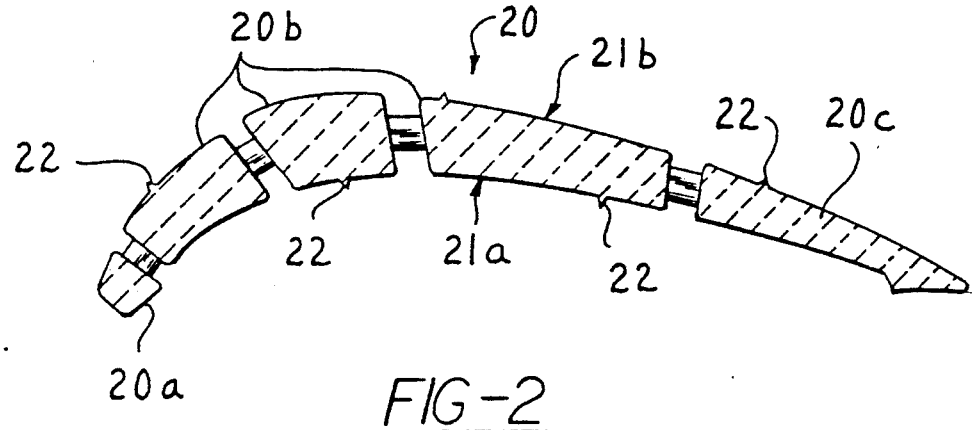
FIG. 2 is a schematic view of a ceramic core in accordance with one embodiment of the invention for use in making the cast blade of FIG. 1.

Referring to FIGS. 2 and 3A-3B, the number, configuration and location of the protrusions 22 on the core 20 for making the airfoil 10 shown in FIG. 1 are illustrated. The protrusions 22 each comprise a frustoconical body 23 defined by an included angle of, for example, 40°, although other included angles may be used in practicing the invention. As shown in FIG. 4, the body 23 joins the external core surface 21 at a radiused transition region (e.g., a radius of 0.0075 inch) and terminates in an outer end 25 defined by intersecting radii of, for example, 0.0075 inch, although other radii can be used in practicing the invention. An exemplary height of the protrusions 22 beyond the external core surfaces 21*a*,21*b* is controlled or determined by the casting wall thickness requirement at each given wall location. Protrusion heights from 0.020 to 0.045 inch have been used in practicing the invention for casting wall thicknesses from 0.018 to 0.055 inch.

The core 20 is formed by any of the known molding processes (e.g., injection molding, transfer molding, pouring) where silica, zircon, alumina, etc. particulates (e.g., fluor) are molded in a master core configuration to produce a green core which is then fired at elevated temperature to develop requisite core strength. For example, a typical silica-zircon core 20 useful in practicing the invention is formed by injecting a ceramic slurry (comprising 80 weight % silica and 20 weight % zircon in a wax or silicone resin binder) in a suitably shaped injection mold cavity at 110° F. Conventional core injection mold tooling can be used to practice the invention with suitable modification (machining) of the mold to produce the protrusions 22 on the molded core 20. After removal from the injection molding cavity, the green core is fired at an elevated temperature to develop required core strength. As mentioned above, the elevated temperature firing of the green core oftentimes causes the thinner regions R1 of the core configuration to experience unwanted distortion from the preselected master core configuration, resulting in a twisting or bowing of the core.

The fired ceramic core 20 is positioned in a pattern molding cavity 30 having a configuration corresponding to the airfoil 10. For example, referring to FIG. 5, the pattern molding cavity 30 is formed between mold halves or blocks 32*a*,32*b* of a pattern mold 32, such as a conventional pattern mold. The fired core 20 is positioned in the molding cavity 30 solely by engagement of the protrusions 22 with the rigid walls 33 defining the molding cavity 30 so that the core as-formed (i.e., molded and fired) is flexed, if necessary, to substantially conform to a predetermined and/or empirically determined relationship between the master core configuration and the molding cavity 30 in spite of any distortion present from the core manufacturing process. As a result, when the fired core 20 is positioned in the pattern molding cavity 30 between the closed mold halves 32*a*,32*b*, the distorted region(s) are caused to conform to the master core configuration. As a further result, the external core surfaces 21*a*,21*b* are spaced accurately from the walls 33 in the molding cavity 30 as if it corresponded to the master core configuration such that, upon injection of pattern material in the cavity 30, the thickness of the pattern material will be accurately controlled.

Alternately, the core 20 can be located in an empirically determined relationship in the molding cavity 30 by prewaxing the various core sections 20*a*,20*b*,20*c* together before placing the core 30 in cavity 30 as needed to achieve the desired core-to-cavity relationship.

Figure 5:
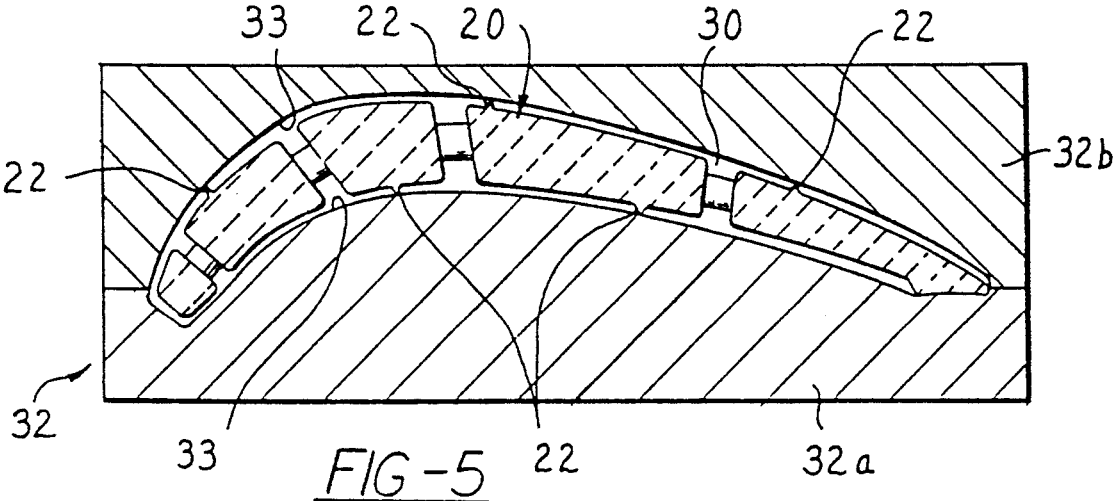
FIG. 5 is a schematic transverse sectional view of the core positioned in a pattern molding cavity.
Figure 6:
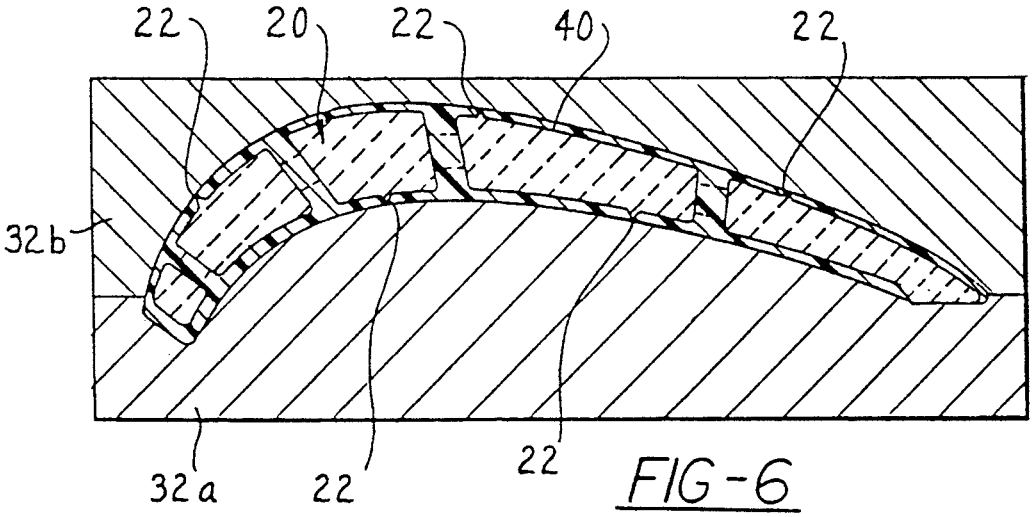
FIG. 6 is similar to FIG. 5 after the pattern is molded about the core.

A fugitive (e.g., wax) airfoil-shaped pattern 40, FIG. 6, corresponding to the casting to be formed is molded about the external core surfaces 21*a*,21*b* while the fired core 20 is supported in the predetermined and/or empirically determined relationship relative to the pattern molding cavity 30 by the protrusions 22, FIG. 5. The thickness of the pattern 40 is thereby accurately controlled about the core 20, FIG. 6. In most instances, the wax pattern prevents subsequent return of the distorted core regions to their former distorted condition. If any core distortion were to occur, it would involve distortion of the wax and core as a unit together, thereby not impacting wall thickness control.

Since the outer ends 25 of the protrusions 22 are engaged with the walls 33, the outer ends 25 remain exposed, or recessed slightly below, relative to the exterior surface of the injected pattern 40.

Typically, the pattern material (e.g., wax) in the molten condition is injected under pressure into the molding cavity 30 about the core 20 and allowed to solidify thereabout.

Figure 7:
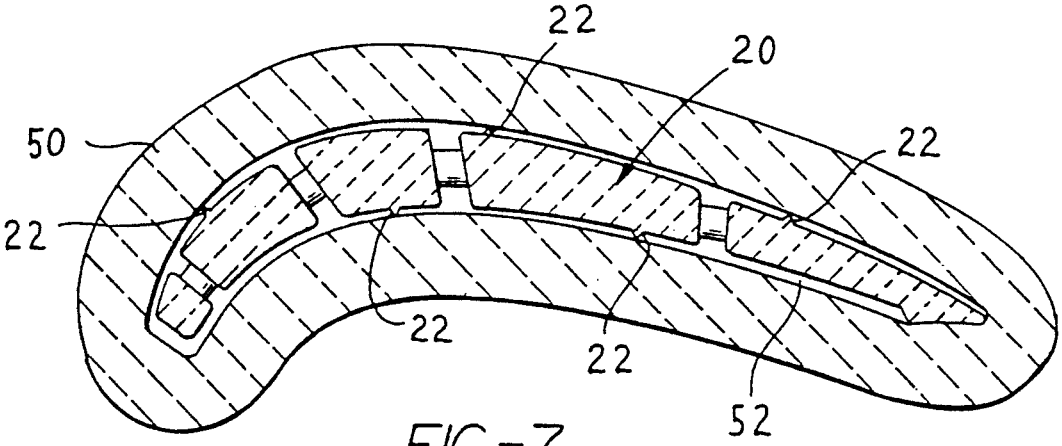
FIG. 7 is a schematic sectional view illustrating the core after the ceramic shell mold is invested thereabout and after the pattern is selectively removed from the shell mold.

The assembly of the core 20 and the fugitive pattern 40 is then invested in ceramic material to form a ceramic shell mold 50 thereabout. The ceramic shell mold 50 is shown in FIG. 7 after removal of the pattern 40. The ceramic shell mold is formed in accordance with conventional shell mold practice wherein the core/pattern assembly is successively dipped in ceramic slurry and stuccoed with coarser ceramic particles to build-up a multi-layer ceramic shell of desired thickness about the core/pattern assembly. The ceramic shell mold 50 (i.e., inner mold cavity wall) engages or slightly clears (i.e., is spaced from) the exposed outer ends 25 of the protrusions 22. A typical ceramic shell thickness formed about the core/pattern assembly is about $\frac{3}{8}$ inch thick. Various ceramic materials including, but not limited to, silica, zircon, alumina, etc. particulates can be employed for the shell mold 50.

Following formation of the ceramic shell mold 50, the core/pattern/shell mold assembly is subjected to a pattern removal operation to selectively remove the pattern 40. A typical operation involves heating the invested assembly to melt the pattern 40 and cause the melted pattern material to drain from the assembly. Heating of the assembly may be effected in a suitable furnace, a steam autoclave, a microwave unit, and other suitable heating devices.

When the pattern 40 is removed, the core 20 is left accurately positioned and supported in the airfoil-shaped shell mold 50 (i.e., in shell mold casting cavity 52) solely by the protrusions 22 on the external core surface 20 in a predetermined relationship and/or empirically determined relationship that corresponds to those mentioned above between the core 20 and the molding cavity 30. As is apparent, this relative positioning between the core 20 and the shell mold casting cavity 52 results from the prior pattern molding operation to conform the core 20 to the desired predetermined and/or empirically determined relationship between the core 20 and the pattern molding cavity 30. Thus, the space between the external core surfaces 21*a*,21*b* and the ceramic shell mold 50 is accurately controlled by the protrusions 22 integrally molded on the core and engaged to the inner wall of the shell mold 50. Since the space will be filled with molten metal to form the casting wall thickness, the cast wall thickness is accurately controlled.

After pattern removal, the core/shell mold assembly is fired at a suitable elevated temperature to develop requisite shell strength for casting. Thereafter, the core/shell mold assembly is preheated to an elevated temperature in preparation for casting; for receiving the molten metal. For casting a nickel base superalloy, the assembly is typically preheated between about 1600° to about 2600° F., depending on the casting process to be employed.

A molten metal charge is then introduced (e.g., poured) into the shell mold casting cavity 52 between the core 20 and the ceramic shell mold 50 and is solidified therein about the core 20 to form the airfoil casting 10 having the root 14 and the airfoil 16 with the internal cooling passages 12 therein, FIG. 1. As mentioned above, the molten metal may be solidified in a manner to produce an equiaxed, directionally solidified, or single crystal grain structure in the casting. The invention can be used to cast myriad known alloy compositions such as, for example only, nickel base superalloys, cobalt base superalloys, stainless steel, etc.

During preheating of the core/ceramic shell mold assembly and during the casting operation when the molten metal is introduced and solidified in the cavity 52, the core 20 is subjected to elevated temperatures, thermal gradients along its length and molten metal pressure that heretofore could result in unwanted core distortion or movement that adversely affected the wall thickness of the casting to the extent that it would be rejected. Moreover, the mold 50 and core 20 may thermally expand at different rates. The protrusions 22 on the core 20, however, eliminate or substantially reduce such core distortion or displacement (core movement) as a result of their engaging the ceramic shell 50 should such core distortion and/or core movement occur. In effect, the protrusions 22 maintain the core 20 substantially in the desired predetermined and/or empirically determined relationship desired between master core configuration and the shell mold casting cavity 52.

Figure 9:
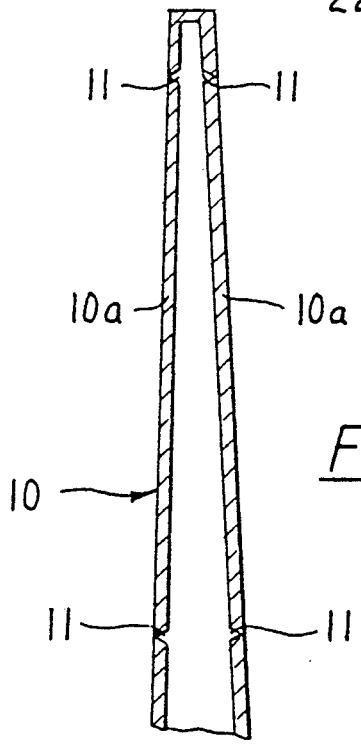
FIG. 9 is a partial longitudinal sectional view of a hollow cast turbine blade made in accordance with the invention.

After the casting 10 is solidified, the core 20 and the ceramic shell mold 50 are removed by conventional techniques to free the casting. For example, the shell 50 is removed by water blasting while the core 20 is removed by chemically leaching (dissolving) such as a high temperature/pressure caustic treatment in an autoclave. The resultant casting 10 may have holes 11 in the casting wall 10*a* thereof, FIG. 1. The holes 11 are in communication with the internal passages 12 at locations where the protrusions 22 formerly resided. Alternately, the holes 11 may be recessed slightly below the outer surface of the casting wall 10*a* as shown in FIG. 9.

Use of the protrusions 22 on the core 20 to position the core in the pattern molding cavity 30 and to ultimately position the core 20 in the shell mold casting cavity 52 substantially improves thickness control of the casting wall. Moreover, use of the protrusions 22 integrally formed on the external core surface 22 eliminates raised or recessed metal on the casting wall 10*a* and thereby eliminates the need to mechanically finish (e.g., grind, blast or belt of the wall) or otherwise further treat the casting wall 10*a* to remove the unwanted metal. The holes 11 that are left in the casting wall by removal of the protrusions 22 are tolerable from a casting performance standpoint and require no treatment. Although some minimal airflow loss (e.g., less than 2% of total) occurs through the holes during use of the casting in a gas turbine engine, it can be compensated for in the final airflow calculations.

The present invention is advantageous in that thin ceramic cores 20 which normally exhibit distortion (e.g., warpage) at one or more of the stressed regions as a result of a core firing step can be used in the manufacture of castings having acceptable wall thickness control. Also, any initially undistorted core which distorts or moves during subsequent exposure to elevated temperatures (e.g., mold preheating and metal casting) is maintained in the desired relationship by the present invention. The overall cost to produce castings having controlled wall thickness is thereby reduced by the present invention. Moreover, the wall thickness of the casting can be controlled to tighter tolerances than heretofore achievable.

The following example of the invention is offered for purposes of illustration and not limitation.

EXAMPLE

A ceramic core 20 of the general type shown in FIGS. 3A—3B was formed by transfer molding (or injection molding) a ceramic slurry comprising 80 weight % silica and 20 weight % zircon such that the admixture had a particle size distribution ranging from 70 mesh to −325 mesh. A thermosetting (e.g. silicone resin) or thermoplastic (e.g. wax based) binder system was added to the admixture which is then injected into a core mold cavity machined to form the protrusions 22 at predetermined locations on the external core surface at temperatures ranging from 70 to 500 degrees F. The protrusions 22 were formed at numerous locations on the core 20 defining the airflow passages in the airfoil as shown, for example, in FIGS. 3A,3B. The protrusions 22 had the dimensions set forth hereinabove with protrusion heights corresponding with the required wall thickness of the casting at the locations. The molded core was removed from the core mold cavity and fired at 2050° F. for 48 hours to remove the binder system and sinter the remaining ceramic ingredients. Other firing temperatures and times in the ranges of 2000–3000 degrees F. for 20–60 hours can be used to fire the cores depending on their composition/binder system to remove the binder system and sinter the remaining ceramic ingredients. The fired core was positioned in a pattern molding cavity shaped to correspond to the airfoil casting 10 and wax pattern material was injected at a wax temperature of about 115° F. about the core. The core included a core print at the lower end but none at the upper end.

Upon solidification of the pattern, the core/pattern assembly was removed from the molding cavity and subjected to successive dips in a ceramic slurry comprising zircon/alumina and stuccoed with alumina ceramic stucco or particle (mesh −14+28) until a ⅜ inch thick ceramic shell was built-up. The wax pattern was removed by steam dewaxing, leaving the core solely supportively spaced in the metal casting cavity by the protrusions 22. The resultant core/shell mold assembly was fired at 1700° F. for 4 hours in air. Prior to casting, the core/shell mold assembly was preheated to 2820° F. A charge of 31 lbs. of nickel base superalloy (PWA-1484 SC-2000) at a casting temperature of 2665° F. was introduced into the shell mold about the core and solidified to yield a single crystal casting. The ceramic shell mold was removed by water blasting while the core was removed by a high temperature/pressure caustic treatment in an autoclave.

Figure 8:
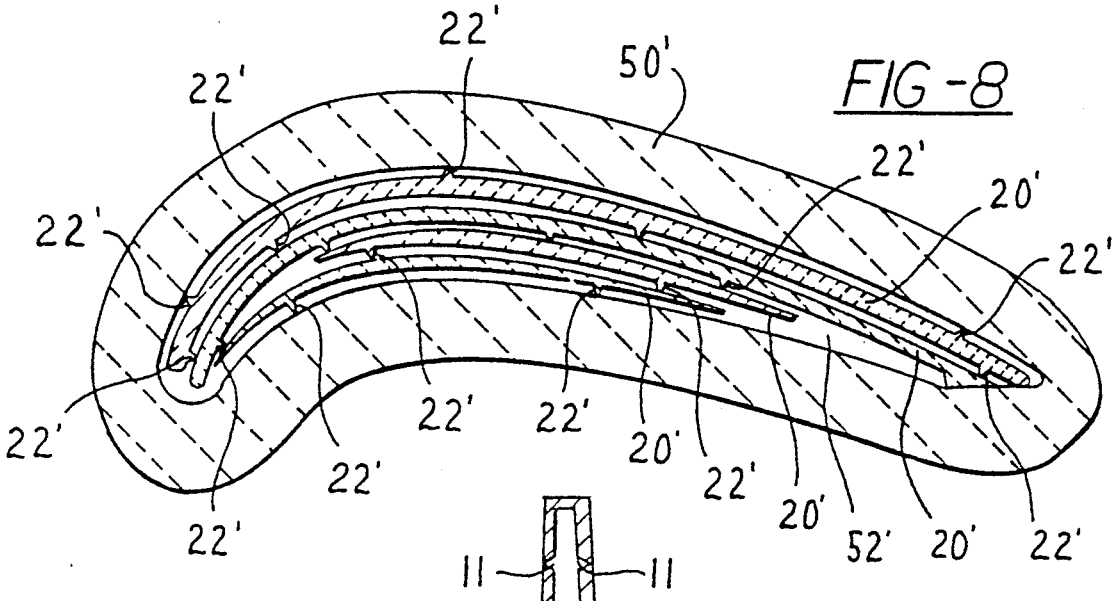
FIG. 8 is a schematic sectional view illustrating another core embodiment of the invention for controlling outer and multiple inner wall thicknesses of the casting.

FIG. 8 illustrates another core embodiment of the invention wherein multiple cores 20' are stacked together and have protrusions 22' for controlling not only external wall thickness but also multiple internal wall thicknesses of the casting formed in the casting cavity 52' of the mold 50' as will be apparent from the arrangement of cores 20'.

While the invention has been described in terms of specific embodiments thereof, it is not intended to be limited thereto but rather only to the extent set forth hereafter in the following claims.

The embodiments of the invention in which an exclusive property or privilege is claimed are defined as follows:

1. A method for improving wall thickness control between an internal passage and an outer surface of a hollow casting, comprising the steps of:

a) providing a core having an external surface configured to form said passage in the casting and having a plurality of integrally formed protrusions extending from said external surface at relatively thin regions of said core deviating from a determined relationship of a master core configuration relative to a molding cavity, b) positioning the core in a molding cavity solely by engagement of the protrusions with rigid walls defining the molding cavity such that the core is substantially conformed to the determined relationship between the master core configuration and the molding cavity by said engagement, c) molding a fugitive pattern corresponding to the casting to be formed about the external surface of said core while said core is positioned in said determined relationship to said molding cavity whereby the wall thickness of the pattern is controlled about the core, d) investing a ceramic shell mold about the pattern and core, e) removing the pattern from the invested shell mold, leaving the core positioned in a shell mold cavity, f) heating the mold with the core therein prior to casting molten metal in the shell mold cavity, and g) casting molten metal in the shell mold cavity about the core, h) wherein in at least one of steps e), f) and g), said protrusions of said core engage said mold in response to core displacement or distortion to maintain said core substantially conformed to said determined relationship.

2. The method of claim 1 wherein the core is formed by molding a ceramic slurry to the master core configuration and firing the molded master core configuration at elevated temperature to impart strength thereto.

3. The method of claim 2 wherein firing of the master core configuration causes the relatively thin region of the core configuration to exhibit distortion from the master core configuration.

4. The method of claim 3 wherein in step b), positioning of the formed core in the molding cavity forces the distorted region to conform to the master core configuration.

5. The method of claim 1 wherein in step c), a wax pattern is molded about the core in the molding cavity.

6. The method of claim 1 wherein in step c), the pattern is molded in the configuration of a turbine airfoil and the core is configured to form an air cooling passage in the airfoil.

7. The method of claim 1 wherein the ceramic shell is invested about the pattern by successively applying a ceramic slurry and ceramic stucco to the pattern to build up a multi-layer shell.

8. The method of claim 1 including in step f), heating the shell mold to a casting temperature.

9. The method of claim 1 wherein each protrusion comprises a radiused outer end.

10. A hollow casting made by the method of claim 1.

11. A method for improving wall thickness control of a hollow airfoil casting between an internal casting cooling passage and an outer casting surface, comprising the steps of:

a) providing a fired ceramic core having an airfoil-shaped external surface configured to form said cooling passage in the casting and having a plurality of integrally formed protrusions extending from said external surface at relatively thin, trailing edge passageway-forming regions of said core deviating from a determined relationship of a master core configuration relative to a molding cavity, b) positioning the core in a molding cavity having a configuration corresponding to the airfoil solely by engagement of the protrusions with rigid walls defining the molding cavity such that the core is substantially conformed to the determined relationship between the master core configuration and the molding cavity by said engagement, c) molding a fugitive airfoil-shaped pattern corresponding to the casting to be formed about the external surface of said core while said core is positioned in said determined relationship to said molding cavity whereby the wall thickness of the pattern is controlled about the core, d) investing a ceramic shell mold about the pattern and core, e) removing the pattern from the invested shell mold, leaving the core positioned in an airfoil-shaped shell mold cavity f) heating the mold with the core therein prior to casting molten metal in the shell mold cavity, and g) casting molten metal in the shell mold cavity about the core, h) wherein in at least one of steps e), f) and g), said protrusions of said core engage said mold in response to core displacement or distortion to maintain said core substantially conformed to said determined relationship.

12. The method of claim 11 wherein positioning of the formed core in the molding cavity in step b) forces relatively thin region of said core to conform to the master core configuration.

13. A hollow airfoil casting made by the method of claim 11.

14. A method for improving wall thickness control of a hollow airfoil casting between an internal casting cooling passage and an outer casting surface comprising the steps of:

a) providing a fired core having an airfoil-shaped external surface configured to form said cooling passage in the casting and having a plurality of integrally formed protrusions extending from said external surface at relatively thin regions of said core prone to be distorted from a determined relationship of a master core configuration relative to a molding cavity, b) positioning the core in a molding cavity having a configuration corresponding to the airfoil solely by engagement of the protrusions with rigid walls defining the molding cavity such that the core is conformed substantially to a determined relationship between the master core configuration and the molding cavity by said engagement, c) molding a fugitive airfoil-shaped pattern corresponding to the casting to be formed about the external surface of said core while said core is positioned in said determined relationship to said molding cavity whereby the wall thickness of the pattern is controlled about the core, d) investing a ceramic shell mold about the pattern and core, e) removing the pattern from the invested shell mold, leaving the core positioned in an airfoil-shaped shell mold cavity, f) heating the mold with the core therein prior to casting molten metal in the shell mold cavity; and g) casting molten metal in the shell mold cavity about the core, and h) wherein in at least one of steps e), f) and g), said protrusions of said core engage said mold in response to core displacement or distortion to maintain said core substantially conformed to said determined relationship.

15. The method of claim 14 wherein the protrusions are provided on a relatively thin trailing edge passageway-forming region of the core.

* * * * *

UNITED STATES PATENT AND TRADEMARK OFFICE

CERTIFICATE OF CORRECTION

PATENT NO. : 5 296 308

DATED : March 22, 1994

INVENTOR(S) : Charles F. Caccavale, et al

It is certified that error appears in the above-identified patent and that said Letters Patent is hereby corrected as shown below:

Column 10, line 51; after "print" insert ---(e.g. core section 20d of Fig. 3A)---.

Column 12, line 28; replace "substantially conformed to the" with ---conformed substantially to a---.

line 41; after "cavity" insert ---,---.

line 52; after "forces" insert ---the---.

Column 13, line 5; replace "conformed substantially to a" with ---substantially conformed to the---.

Signed and Sealed this

Thirteenth Day of September, 1994

*Attest:*

*Attesting Officer*

BRUCE LEHMAN

*Commissioner of Patents and Trademarks*